United States Patent [19]

Hashizume

[11] 4,429,662

[45] Feb. 7, 1984

[54] METHOD AND APPARATUS FOR GENERATING VAPOR

[75] Inventor: Kenichi Hashizume, Tokyo, Japan

[73] Assignee: Tokyo Shibaura Denki Kabushiki Kaisha, Kanagawa, Japan

[21] Appl. No.: 397,790

[22] Filed: Jul. 13, 1982

Related U.S. Application Data

[63] Continuation of Ser. No. 159,491, Jun. 16, 1980, abandoned.

[30] Foreign Application Priority Data

Jun. 21, 1979 [JP] Japan ..... 54-77503
Jul. 24, 1979 [JP] Japan ..... 54-93303

[51] Int. Cl.[3] ..... F22B 1/02
[52] U.S. Cl. ..... 122/32; 122/34; 165/143
[58] Field of Search ..... 122/488, 491, 31 R, 122/32, 34, 39, 40; 165/143, 144, 154

[56] References Cited

U.S. PATENT DOCUMENTS

| | | | |
|---|---|---|---|
| 1,918,601 | 7/1933 | Jacocks et al. | 165/143 |
| 2,004,391 | 6/1935 | Price et al. | 165/143 |
| 3,048,373 | 8/1962 | Bauer et al. | 122/32 |
| 3,060,921 | 10/1962 | Luring et al. | 122/32 |
| 3,129,077 | 4/1964 | Adams | 165/143 |
| 3,177,934 | 4/1965 | Hoppe, Jr. et al. | 165/143 |
| 3,199,583 | 8/1965 | Hood, Jr. et al. | 165/143 |
| 3,228,456 | 1/1966 | Brown et al. | 165/180 |
| 4,046,110 | 9/1977 | Fritz et al. | 122/32 |
| 4,078,660 | 2/1978 | Tsao | 122/34 |
| 4,210,199 | 7/1980 | Doucette et al. | 165/143 |
| 4,323,114 | 4/1982 | Corey | 122/32 |

*Primary Examiner*—Henry C. Yuen
*Attorney, Agent, or Firm*—Stevens, Davis, Miller & Mosher

[57] ABSTRACT

In a first evaporator liquid to be evaporated, i.g., water or a refrigerant is heated by hot water or hot gas to generate a liquid-vapor mixture which is admitted into a second evaporator to separate liquid from the vapor. In the second evaporator the separated vapor is evaporated by the hot water or hot gas, and the vapor in the second evaporator is supplied to a steam turbine coupled to an electric generator.

10 Claims, 7 Drawing Figures

METHOD AND APPARATUS FOR GENERATING VAPOR

This is a Continuation of application Ser. No. 159,491 filed June 16, 1980, now abandoned.

BACKGROUND OF THE INVENTION

This invention relates to a method and apparatus for generating vapor, more particularly steam or vapor suitable for use in an electric power generating plant in which water or low boiling point liquid such as freon is vaporized by using subground hot water or industrial hot or warm waste water or flue hot gas and the resulting steam is utilized to drive a steam or vapor turbine.

In the prior art geothermal electric power generation plant, only steam collected from subground was used and subground hot water was not utilized efficiently. In recent years, use of thermal energies at a relatively low temperature such as the subground hot water and industrial hot water for generating steam has become important. In such apparatus for generating steam or vapor, a heat exchanger is provided to heat water by relatively low temperature hot water or low boiling point liquid such as freon to generate steam for driving a steam turbine coupled to a generator.

FIG. 1 shows a prior art steam generating apparatus or heat exchanger utilized for this purpose which comprises a cylindrical vessel 1 provided with a hot water ($R_L$) inlet port 1*a* on the lower side at one end and an exit port 1*b* for discharging generated steam $R_V$ on the upper side and at the other end. The opposite ends of the vessel 1 are closed by header plates 2 and 3 between which a plurality of heat transfer tubes 4 extend. The header plates 2 and 3 are covered by cup shaped end plates 5 and 6. The interior of the end plate 5 is divided by a partition plate 7 into upper and lower compartments. The lower compartment is provided with an inlet port 5*a* for hot water W, whereas the upper compartment is provided with an exit port 5*b* for the used hot water. Thus, the hot water W flows from the inlet port 5*a*, lower heat transfer tubes 4, a chamber within the righthand end plate 6, upper heat transfer tubes 4 and finally discharged from the exit port 5*b*, as shown by arrows. On the other hand the water $R_L$ to be evaporated flows about the heat transfer tubes 4 and the resulting steam $R_V$ is discharged through the exit port 1*b*.

Since this type of steam generator utilizes a pool boiling phenomenon, heat transfer coefficient is low with the result that the thermal energy of the hot water is not used efficiently, thus requiring a large amount of the hot water or large heat transfer surface.

Consequently, it has been desired to develop an efficient and compact steam generator utilizing relatively low temperature hot water as subground hot water or industrial hot waste water.

SUMMARY OF THE INVENTION

Accordingly, a principal object of this invention is to provide a novel method and apparatus capable of generating steam or vapor by utilizing a relatively low temperature heating fluid.

Another object of this invention is to provide a novel method and apparatus capable of generating vapor or steam that can be used for operating a turbine coupled to an electric generator and can be used to cool brine or water for air conditioner or the like after it has been used to evaporate the liquid.

According to one aspect of this invention there is provided a method of generating vapor, characterized by comprising the steps of preparing a first evaporator in which a liquid is heated by a heating fluid having a higher temperature than the first liquid to form a mixture of the first liquid and vapor thereof and a second evaporator including a heat transfer tube for evaporating the liquid of the mixture; simultaneously passing the liquid and the heating fluid through the first evaporator in a heat transfer relationship, thus forming the mixture of the liquid and the vapor thereof; admitting the mixture into the second evaporator to separate the vapor from the liquid; passing the separated liquid about the heat transfer tube in the second evaporator to substantially completely evaporate the separated liquid; and supplying the vapor in the second evaporator to vapor utilization apparatus.

According to another aspect of this invention there is provided apparatus for generating vapor, characterized by comprising serially connected first and second evaporators, the first evaporator comprising an outer tube, a first heat transfer tube concentrically contained in the outer tube with a gap therebetween, means for passing a liquid to be evaporated through either one of the gap and the first heat transfer tube, and means for passing a heating fluid at a higher temperature than the liquid through the other one of the first heat transfer tube and the gap thereby forming a mixture of the liquid and vapor thereof while the liquid flows through the gap or the first heat transfer tube; means for supplying the vapor-liquid mixture into the second evaporator so as to separate the liquid from the vapor, and the second evaporator comprising a second heat transfer tube and means for causing the separated liquid to flow about the second heat transfer tube thereby evaporating substantially completely the separated liquid.

In a modification, the first evaporator is helically wound about the second evaporator. The liquid to be evaporated may be plain water or a refrigerant and the heating fluid may be subground hot water, factory waste water or brine.

DESCRIPTION OF THE PREFERRED EMBODIMENT

Figure 1:
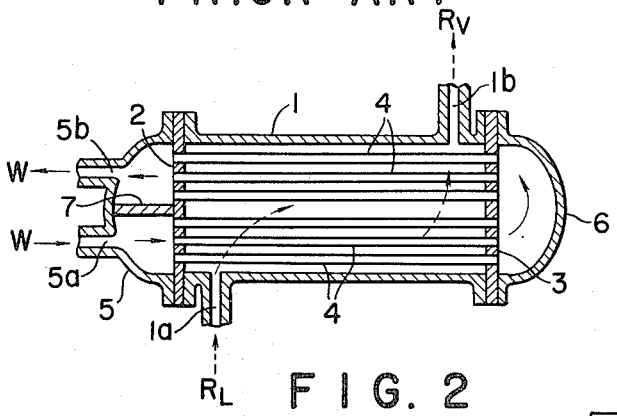
FIG. 1 PRIOR ART
FIG. 1 is a longitudinal sectional view showing a prior art steam generator.

The principle of this invention will firstly be described with reference to FIG. 2. The steam generator shown therein comprises a first evaporator 10 by which a mixture of water and steam having a predetermined steam-water ratio is obtained, and a second evaporator 20 in which the water is caused to flow down as a thin water film along the surface of a heat transfer tube to be evaporated. More particularly, the first evaporator 10 comprises a cylinder 11 having an inlet port 11*a* for admitting water $R_L$, that is a liquid to be evaporated, and an exit port 11*b* at the opposite end for discharging a mixture of the water and steam. A heat transfer tube 14 is provided to concentrically extend through the cylinder 11 to pass hot water W. The exit port 11*b* is connected to the inlet 21*a* at the upper portion of the vessel 20 of the second evaporator 20 through a conduit 15. A distributor 22 is disposed in the second evaporator 20 at a position beneath the inlet port 21*a*, and a heat transfer tube 24 passed through hot water W is disposed below the distributor 22 which is formed with an opening 25 for causing the water supplied through the inlet port 21*a* to flow down about the heat transfer tube 24 in the form of a thin water film. Accordingly, the steam generated in the first and second evaporators 10 and 20 is discharged to a load, for example a steam turbine, not shown.

In operation, as the water $R_L$ flows along the heat transfer tube 14, a portion of the water evaporates and a mixture of water and steam is discharged from the exit port. At this time, the ratio of steam to water gradually increases towards the exit port 11*b*.

Figure 3:
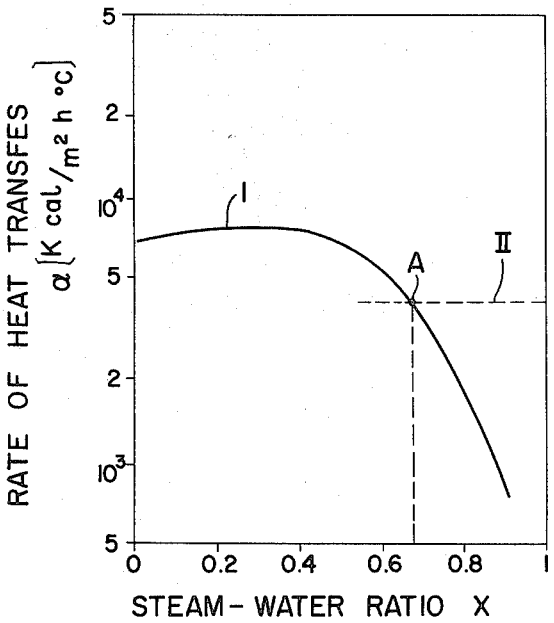
FIG. 3 is a graph showing the relationship between the steam-water ratio and the rate of heat transfer.

The relationship between this ratio X and the rate of heat transfer $\alpha$ is shown by a curve I depicted in FIG. 3. Freons (Trade Mark) also manifest similar characteristic. As shown in FIG. 3 as the steam-water ratio X increases beyond 0.5 the rate of heat transfer $\alpha$ decreases rapidly. This can be attributed to the so-called dry out in which the outer surface of the heat transfer tube 14 becomes dry caused by a diminishing of a liquid film formed about the heat transfer tube 14. For this reason, the first evaporator 10 is designed such that the rate of heat transfer $\alpha$ would not decrease beyond a certain limit.

In the second evaporator 20, the heat transfer rate $\alpha$ can be made to be any desired value by varying the thickness of the water film formed on the surface of the heat transfer tube 24, i.e., the amount of water flowing downwardly but should be limited to a specific value from the practical view point. Where the liquid to be evaporated is water or a refrigerant, for example Freon, the rate of heat transfer $\alpha$ is about $4\times10^3$ Kcal/m$^2$h °C. as shown by dotted lines II in FIG. 3. By constructing the apparatus of this invention such that the steam-water ratio X at the cross point A between curves I and II would be substantially 0.7, the evaporation in the first evaporator 10 proceeds along curve I to produce a steam-water mixture $R_{LV}$ containing 70% of steam and the remaining water is completely evaporated in the second evaporator. It was found that the steam-water ratio X of 0.6–0.8 is advantageous for practical use where water or Freon is evaporated. Thus, it is possible to generate steam by the effective utilization of hot water without using a large heat transfer area. Instead of subground hot water, or hot factory waste liquid can also be used.

Figure 4:
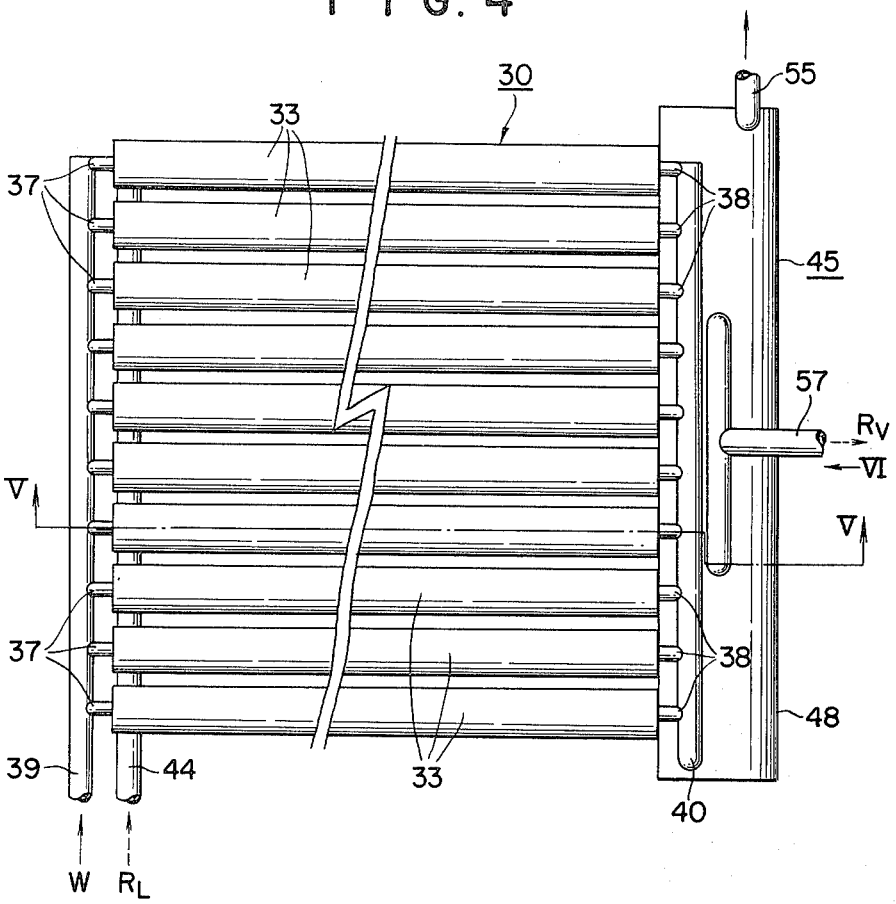
FIG. 4 is a plan view showing one embodiment of the steam generator of this invention.

A practical embodiment of this invention based on the principle described above will now be described with reference to FIGS. 4, 5 and 6 which comprises a first evaporator 30 constituted by a plurality of tubes 33 each closed by end plates 31 and 32. Each tube 33 comprises header plates 34 and 35 between which a plurality of heat transfer tubes 36 extend. Inlet tube 37 and exit tube 38 are connected respectively to end plates 31 and 32. Inlet tubes 37 are commonly connected to a hot water supply tube 39, while exit tubes 38 are commonly connected to a discharge tube 40 for the used hot water. Water to be evaporated is supplied into a space between the heat transfer tubes 36 from a tube 44 located near one header plate, while a steam-water mixture is discharged into a second evaporator 45 through an exit pipe 60 near the header plate 35. The diameter and length of the tubes 33, and the diameter, length and number of the heat transfer tubes 36 are selected such that the steam-water ratio at the exit will vary from 0.6 to 0.8 depending upon the material of the tubes, type, temperature and flow velocity of the hot water W and the water or liquid to be evaporated.

Figure 5:
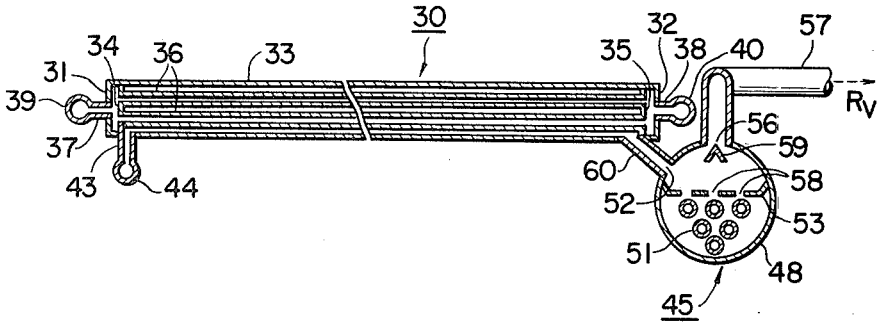
FIG. 5 is a sectional view taken along a line V—V shown in FIG. 4.
Figure 6:
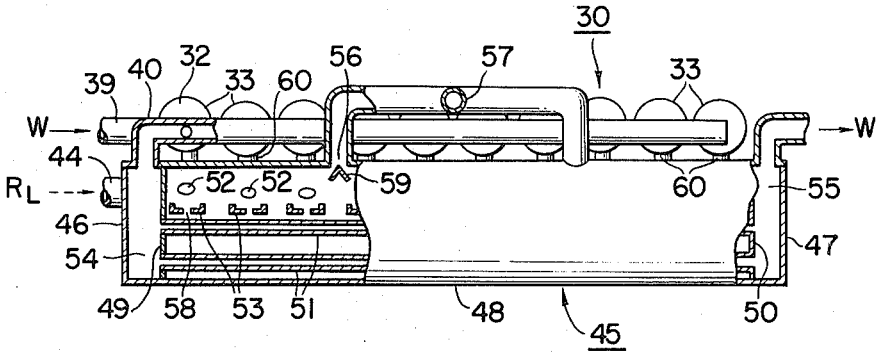
FIG. 6 is a side view, partly cut away, of the steam generator as seen in a direction of an arrow VI shown in FIG. 4

As shown in FIGS. 5 and 6 the second evaporator comprises a plurality of heat transfer tubes 51 extending between spaced header plates 49 and 50 and communicated with the discharge tube 40 or connected in parallel with the hot water supply pipe 39, a distributor 53 formed with a plurality of openings 58 or made up of a plurality of juxtaposed spaced sections with openings 58 therebetween, and plates 46 and 47 for defining plenum chambers 54 and 55, a steam exit port 56 at the upper end of the second evaporator 45 and connected to a steam discharge pipe 57, and a steam-water separator 59 at the entrance of the steam entrance port 56. The diameter, length and number of the heat transfer tubes 51 are selected according to the type, temperature and flow velocity of the hot water or other heating liquid as well as the type, temperature, flow quantity and ratio of steam and water or liquid to be evaporated so that all water supplied will be completely evaporated.

Figure 2:
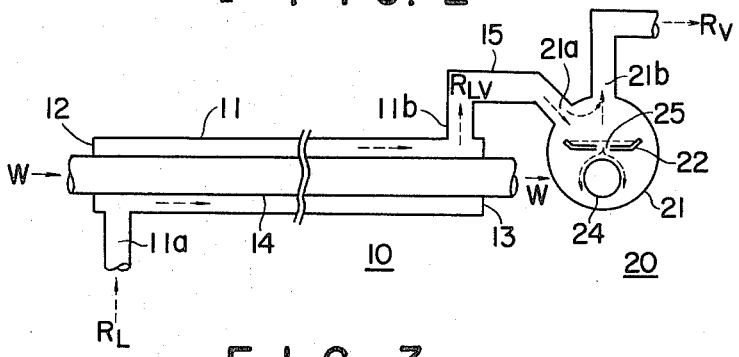
FIG. 2 is a diagrammatic sectional view showing a basic form of a steam generator of this invention.

Like the basic embodiment shown in FIG. 2, steam and water generated in the first evaporator 30 and admitted into the second evaporator 45 are separated by the steam water separator 59 and the separated water is caused to flow down about the heat transfer tubes 51 through openings 58. Thus the water is completely evaporated in the second evaporator 45 and the steam therein is supplied to a steam turbine.

As above described, according to this invention it is possible to improve the utilization factor of heat of relatively low temperature hot fluid such as subground water or industrial waste liquid with evaporators of compact construction. The first and second evaporators are interconnected by a simple conduit without using a manifold or other complicated structure.

Although in the foregoing embodiment hot water was passed firstly through the first evaporator and then through the second evaporator, this order of passing may be reversed as will be described later.

In some cases, for the purpose of more efficiently using the heat of the heating liquid Freons (Trade Mark) may be used. For example, where subground hot water having a temperature of 140° C. is used as the heating liquid at a rate of 160 tons/hour and Freon having a chemical formula of $C_2Cl_2F_4$ is used as the liquid to be evaporated, the first evaporator 30 is constituted by three tubes 33 having a diameter of 200 mm and each containing 19 heat transfer tubes 36 each having a diameter of 2.5 cm and a length of 16 meters for obtaining a mixture of vapor and liquid of the Freon at a ratio of 0.7 while the second evaporator 45 contains 57 steel heat transfer tubes 51 each having a diameter of 2.5 cm and a length of 1.8 m to completely evaporate liquid Freon. The heat transfer tubes may be connected in parallel or a suitable member, for example 2 thereof may be connected in series.

Figure 7:
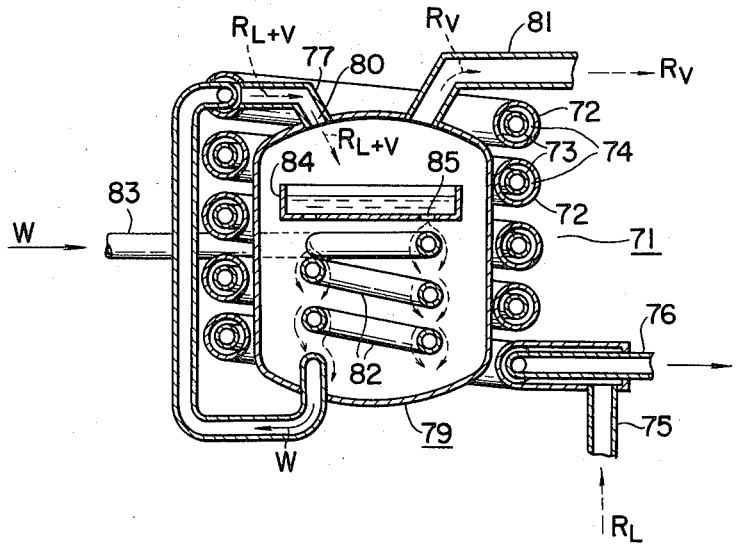
FIG. 7 is a longitudinal sectional view showing a modification of this invention.

FIG. 7 shows a modification of this invention wherein two evaporators or heat exchangers shown in FIGS. 2 through 6 are utilized to evaporate a refrigerant for preparing cold brine or cold water. In this embodiment a first evaporator 71 is disposed about the second evaporator 79. Thus, the first evaporator 71 comprises concentric outer and inner tubes 72 and 73 and is wound helically about a cylindrical second evaporator 79 containing a distributor 84 provided with openings 85 and a water coil 82 beneath the openings 85. In this case, water W utilized to evaporate a refrigerant flows through an inlet 83, water coil 82, inner tube 73 and is finally discharged through an outlet port 76. The refrigerant $R_L$ to be evaporated by the water W enters into an annular space between the inner and outer tubes 73 and 72 and a portion of the refrigerant is evaporated while passing through the first evaporator 71. A mixture $R_{L+V}$ of the vapor of the refrigerant and the liquid refrigerant $R_L$ is supplied to the top of the second evaporator 79. The liquid refrigerant not yet evaporated in the first evaporator 71 is collected in the dish shaped distributor 84 and then flows down about the outer surface of the water coil 82 through openings 85 to be completely evaporated off. The vapor $R_V$ is discharged through exit pipe 81 to a compressor, for example, and the obtained cold brine or cold water can be used for refrigerating or air conditioning system.

From the foregoing description it can be clearly noted that the first liquid to be evaporated is not limited to water or a refrigerant and that the second liquid for evaporating the first liquid is not limited to hot water, provided that the first liquid has a lower evaporation temperature than the second liquid, since the invention is characterized by the efficient utilization of the heat energy of liquid or gas at relatively low temperatures.

To have a more clear understanding of the nature of this invention, the types of fluids R to be evaporated, liquids W used to heat the fluids R, the field of application of the formed steam or vapor are shown in the following table.

TABLE

| field of use of generated steam or vapor | medium R having lower evaporation temp. than high temp. medium W and partially evaporated (at X = 0.6 – 0.8) in first evaporator | medium W having higher evaporation temp. than low temp. medium and used to evaporate medium R in first and second evaporators | field of use of W after heat exchange |
|---|---|---|---|
| turbine, compressor, etc. are driven with steam at one atmospheric pressure and 100° C. | water, evaporated to form steam at 100° C. and one atm. pressure | hot water at a temp. of 200° C. and several tens atm. pressure pumped up from deep stratum; industrial waste gas | |
| turbine, etc. are driven with freon vapor at 6–14 atm. pressure and 60–100° C. | freson R-114 (boiling point, 3.8° C.) is evaporated to form freon vapor at 6–14 atm. pressure and 60–100° C. | industrial waste water at 80–120° C.; underground hot water at one atm. pressure | |
| turbine, etc. are driven with freon vapor at 10–12 atm. pressure and 22–27° C. | freon R-22 (boiling point −40° C.) is evaporated to form freon vapor at 10–12 atm. pressure and 22–27° C. | sea water at 25–30° C. | |
| | freon R-22 is evaporated to form freon vapor at 10–12 atm. pressure and 5–10° C. | water at one atm. pressure at 15–25° C. which is cooled to 12° C. by heat exchange | after heat exchange used as cool water |

What is claimed is:

1. A method of generating vapor comprising the steps of:

preparing a first evaporator in which a liquid is evaporated by a heating fluid having a higher temperature than an evaporating temperature of said liquid to form a mixture of said liquid and vapor thereof and a second evaporator including a heat transfer tube for evaporating said liquid of said mixture;

simultaneously passing said liquid and said heating fluid through said first evaporator in a heat transfer relationship thus forming said mixture of said liquid and vapor thereof, said mixture having a vapor-water ratio of from 0.6 to 0.8;

admitting said mixture into said second evaporator to separate said vapor from said liquid;

passing said separated liquid about said heat transfer tube to substantially completely evaporate said separated liquid; and supplying the vapor in said second evaporator to vapor utilization apparatus.

2. The method according to claim 1 wherein said liquid supplied to said first evaporator is water and said heating fluid comprises underground hot water or industrial waste liquid having a temperature higher than said water.

3. The method according to claim 1 wherein said liquid comprises a refrigerant.

4. The method according to claim 1 wherein said heating fluid comprises hot gas.

5. Apparatus for generating vapor from a liquid comprising:

a first heat exchanger having at least one first heat transfer tube and a first heat transfer jacket, said first heat transfer tube passing through said first heat transfer jacket, whereby a fluid passing through said first heat transfer tube can transfer its heat to a liquid passing through said first heat transfer jacket, said liquid being at a lower temperature than said fluid, to at least partially evaporate said liquid;

means for supplying a heated fluid to said first heat transfer tube;

means for supplying a liquid to said first heat transfer jacket;

a second heat exchanger having at least one second heat transfer tube and a second heat transfer jacket, said second heat transfer tube passing through said second heat transfer jacket;

means for supplying a heated fluid to said second heat transfer tube;

means connecting said first heat transfer jacket to said second heat transfer jacket, whereby the vapor and liquid portions of said partially evaporated liquid of said first heat transfer jacket flows into said second heat transfer jacket;

said second heat exchanger further comprising a vapor exit vent on said second transfer jacket, the vapor portion of said partially evaporated liquid from said first heat exchanger jacket flowing into said second heat exchanger jacket immediately passing out from said second heat exchanger jacket through said vent; and a distributor plate disposed over said second heat transfer tube, said plate being adapted to receive the liquid portion of said partially evaporated liquid from said first heat exchanger jacket flowing into said second heat exchanger jacket, said plate having openings so formed so as to permit said liquid portion to be distributed over said second heat transfer tube in a thin film, whereby said liquid portion is evaporated, the vapor from said evaporated liquid portion passing out from said second heat exchanger jacket through said vent.

6. The apparatus according to claim 5 wherein said first heat exchanger is helically wound about said second heat exchanger.

7. The apparatus according to claim 5 wherein said vapor exit vent has a liquid vapor separator at an input thereto.

8. The apparatus according to claim 5 wherein said liquid supplied to said first evaporator is water and said heating fluid comprises underground hot water or industrial waste liquid having a temperature higher than said water.

9. The apparatus according to claim 5 wherein said liquid comprises a refrigerant.

10. The apparatus according to claim 5 wherein the heating fluid supplied to said first and second heat exchangers comprises hot gas.

* * * * *